United States Patent [19]

Yamauchi

[11] Patent Number: 4,906,606

[45] Date of Patent: Mar. 6, 1990

[54] HEAT TRANSFER FILM

[75] Inventor: Mineo Yamauchi, Iruma, Japan

[73] Assignee: Dai Nippon Insatsu Kabushiki Kaisha, Japan

[21] Appl. No.: 245,730

[22] Filed: Sep. 19, 1988

[30] Foreign Application Priority Data

Sep. 18, 1987 [JP] Japan ..... 62-232378

[51] Int. Cl.[4] ..... B41M 5/26

[52] U.S. Cl. ..... 503/227; 8/471; 428/195; 428/484; 428/488.4; 428/913; 428/914

[58] Field of Search ..... 428/195, 207, 211, 484, 428/488.1, 488.4, 913, 914; 8/471; 503/227

[56] References Cited

U.S. PATENT DOCUMENTS 4,720,480 1/1988 Ito et al. ..... 428/195

*Primary Examiner*—Pamela R. Schwartz

*Attorney, Agent, or Firm*—Arnold, White & Durkee

[57] ABSTRACT

An heat transfer film comprising a base film and a heat transfer layer formed on one surface of said base film, said heat transfer layer having at least one detection mark for allowing a printer to detect the film information such as the position and hue of the heat transfer layer, and either said detection mark or the vicinity thereof selectively reflecting detection light projected on the portion having said detection mark.

8 Claims, 1 Drawing Sheet

HEAT TRANSFER FILM

BACKGROUND OF THE INVENTION

This invention relates to a heat transfer film, more particularly to a heat transfer film, which can simplify the structure of a printer by providing specific detection marks in said heat transfer film.

In the prior art, as a method for forming a color image according to the heat transfer method, there has been practiced the heat transfer method by use of a lengthy heat transfer film having a large number of unit heat transfer layers comprising colored heat transfer layers of, for example, yellow, magenta and cyan (and black, if necessary) provided on a continuous base film.

These lengthy heat transfer films may be classified broadly into (a) the lengthy heat transfer films of the so-called wax type of which heat transfer layers are softened to be thermally transferred in the shape of images onto a heat transferable material, and (b) those of the so-called sublimation type in which the dyes in the heat transfer layers are sublimated (thermally migrated), whereby only the dyes are thermally transferred in the shape of images onto the heat transferable material.

In either type, the above unit heat transfer layers are provided on the continuous base film in a large number of units of 50 to 100, and the film is stored and used as wound into a roll.

When such color images are formed by a printer by use of these heat transfer films, since it is required to allow a printer to detect that heat transfer has been effected in a predetermined order on the heat transferable material (i.e., material to be heat transferred), for example, in the order of yellow, magenta, cyan and black, and what color is existing at the printing portion, detection marks having such information and functions are commonly formed in any region of the heat transfer film.

As a method for allowing a printer to detect such detection marks, the method as shown in FIG. 6 and FIG. 7 has been practiced.

More specifically, in the case shown in FIG. 6, a projector 6 is provided within a printer, while a light receiving sensor 7 is provided on the opposite side to the heat transfer film 10, and by moving the heat transfer film 10, partial interception of the detection light 8 from the projector 6 is detected by the detection mark 3 comprising a light absorbing layer of a different color and existing on the heat transfer film to determine the position of the heat transfer film 10 and the hue of the heat transfer layer.

The method shown in FIG. 7 is practiced by providing a projector 6 and a light receiving sensor 7 on one side of the heat transfer film 10 having the same detection mark 3 and a reflective plate 9 on the other side. In this case, the position and the hue of the heat transfer film 10 are detected by the presence or the absence of the reflected light 11.

The printers generally used in the above heat transfer system are becoming progressively miniaturized and therewith, simplification of circuit wiring and improvement of detection precision, and the like of the detection mark have been demanded. However, in the system of the prior art shown in FIG. 6, since a projector and a light receiving sensor are arranged on both sides of the heat transfer film, it cannot respond to the need for miniaturization of the device.

On the other hand, although the system of FIG. 7 can be miniaturized to some extent, a reflective plate is desired to be provided on the opposite side, which cannot be said to be satisfactory for miniaturization and simplification.

Also, in both of the systems of the prior art, when the heat transfer film is cut during printing, cutting cannot be detected, resulting in problems such as generation of bad images or jamming of the heat transfer film.

Accordingly, an object of the present invention is to provide a heat transfer film which requires no complicated detection mechanism and which can also immediately detect cutting of the heat transfer film as well as the film information, such as the position and hue of the heat transfer layer.

SUMMARY OF THE INVENTION

The above object of the present invention can be accomplished by the present invention as specified below.

More specifically, the present invention is a heat transfer film, comprising a base film and a heat transfer layer formed on one surface of said base film, said heat transfer layer having at least one detection mark for allowing a printer to detect the film information such as the position and hue of the heat transfer layer, and either said detection mark or the vicinity thereof selectively reflecting detection light projected on the portion having said detection mark.

Thus, in the present invention, by providing a detection mark in such a manner that either the detection mark or the vicinity thereof selectively reflects detection light, provision of a reflective plate can be obviated, and also disorders such as cutting, or the like of the heat transfer film can be rapidly remedied.

DETAILED DESCRIPTION OF THE INVENTION

Referring now to the accompanying drawings illustrating schematically preferable examples of the present invention, the present invention is described in more detail.

Figure 1:
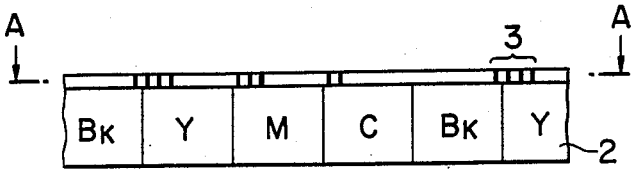
FIGS. 1 through 5 schematically illustrate the heat transfer films of the present invention and effects thereof.
Figure 2:
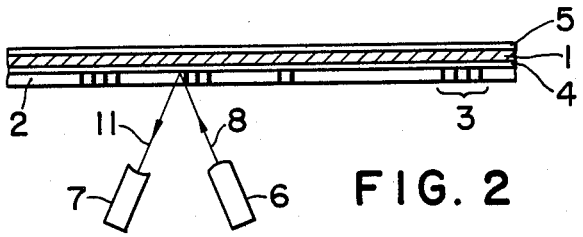

FIG. 1 is a schematic crosssectional view of the heat transfer film of a preferred example of the present invention. FIG. 2 schematically illustrates in more detail the cross-section illustrated in FIG. 1. The heat transfer film of this example has a heat transfer layer 2 comprising the respective hue regions of yellow (Y), magenta (M), cyan (C) and black (Bk) formed on a base film 1, and on a part of the base film 1 adjacent to the heat transfer layer 2 are formed light-absorbing detection marks 3 for informing the position and the hues of the heat transfer film to a printer. By forming a light reflective layer 4 between the base film 1 and the detection mark 3 of the heat transfer film and allowing the detection light 8 projected on the portion having the detection mark 3 to reflect selectively, the object of the present invention can be accomplished.

In the drawings, 5 is a heat resistant layer on the back, which has the function of preventing the thermal head of the printer from sticking thereto, and is preferable but not essential in the present invention.

When printing is performed with such a heat transfer film of the present invention mounted on a printer having a projector 6 and a light receiving sensor 7 on one side, the detection light 8 emitted from the projector 6 following running of the heat transfer film is reflected against the light reflective layer 4 where there is no detection mark 3, and the reflected light 11 is received by the light receiving sensor 7, while the light is absorbed by the detection mark 3 where it exists, and therefore will not reach the light receiving sensor 7. Thus, the detection light 8 is selectively reflected to detect the reflected light 11 by the light receiving sensor 7. Since the reflected light 11 varies depending on the width and shape or distance, etc. of the detection mark 3, the position and hues of the heat transfer film can be detected by the printer therethrough.

Figure 3:
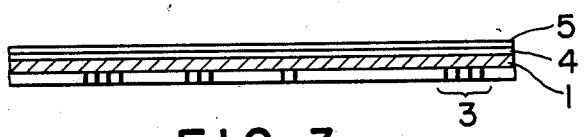

FIG. 3 shows another preferred example of the present invention, and the light reflective layer 4 is provided on the back of the film 1. Also in this case, except that the base film 1 is required to be transparent, the actuation is the same as in FIG. 1 and FIG. 2 to exhibit the same effect.

Figure 4:
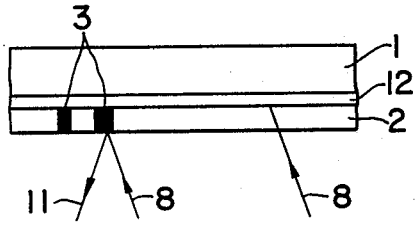
Figure 5:
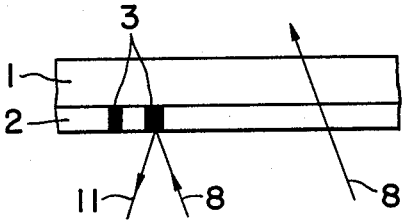
Figure 6:
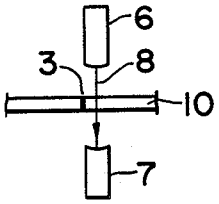
FIGS. 6 and 7 illustrate prior art examples.
Figure 7:
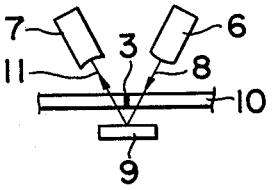

FIG. 4 and FIG. 5 show other preferred examples. In these examples, the detection mark 3 is light reflective and the vicinity thereof is light absorptive (FIG. 4) or light transmissive (FIG. 5). By using a black colored film as a base film 1 or by forming a light absorbing layer 12 around the detection mark 3, the vicinity of the detection mark 3 can be made light absorptive. Further, by using a transparent film or light transmissive film as a base film 1, the vicinity of the detection mark 3 can be made light transmissive. With the above mentioned constitution, the detection light 8 projected on the portion having the detection mark 3 can be effectively reflected as same as above.

The light reflective layer 4 as described above can be formed easily as a vapor deposited film of a metal such as aluminum, or the like, a coating of an ink or paint containing an aluminum pigment, or the like, or a coating of white ink or white paint. On the other hand, the light absorbing layer or the black colored base film may be formed or colored in black in a conventional manner.

The above light reflective layer or the light absorbing layer is not required to be formed to the same width as the base film 1 as shown in FIG. 1 but it may have only a region where the detection mark 3 exists or a region where the detecting light 8 is scanned.

The above examples are those in which the detection marks are formed in strip shape at the side edge. However, in the present invention, the detection marks can be also formed on the heat transfer layer to provide the same actuation, exhibiting the same effect.

Having described above the principal portions of the present invention, the present invention can be utilized for lengthy heat transfer films of both the wax type and the sublimation type as described above.

The lengthy heat transfer film of the wax type is the type with its heat transfer layer being softened by heating by a heating means such as a thermal head, a heat pen, an electric means, light (infrared ray, flash exposure, or laser beam) for heat transfer, to be adhered to the heat transferable material and peeled away from the base film, which is itself well known in the art, and the present invention can utilize any of the lengthy heat transfer films of the wax type.

On the other hand, the lengthy heat transfer film of the sublimation type has a sublimable dye carried with a binder on the continuous base film, which is the type wherein only the dye being migrated by sublimation with the heat of the heating means such as the thermal head to form an image, which is itself well known in the art, and the present invention can be utilized for any of the lengthy heat transfer films of the sublimation type.

According to the present invention as described above, it is not necessary to provide a reflective plate in a printer, and the printer can be further simplified and miniaturized. Further, even when unexpected disorders such as cutting of the heat transfer film or no response to reflected light because of the cutting may occur, rapid response to such disorders can be easily accomplished.

What is claimed is:

1. A heat transfer film comprising a base film and a heat transfer layer formed on one surface of said base film, said heat transfer layer having at least one detection mark for allowing a printer to detect the film information such as the position and hue of the heat transfer layer, wherein the detection mark is light absorptive and the vicinity thereof is light reflective, a light reflective layer being located on the other surface of the base film in the vicinity of the detection mark.

2. A heat transfer film according to claim 1, wherein the heat transfer film is of the wax type.

3. A heat transfer film according to claim 1, wherein the heat transfer film is of the sublimation transfer type.

4. A heat transfer film according to claim 1, wherein the heat transfer layer comprises respective regions of the hues of yellow, magenta and cyan and, optionally, black.

5. A heat transfer film comprising a base film and a heat transfer layer formed on one surface of said base film, said heat transfer layer having at least one detection mark for allowing a printer to detect the film information such as the position and hue of the heat transfer layer, wherein the detection mark is light reflective and the vicinity thereof is light absorptive, a light absorptive layer being located on the other surface of the base film in the vicinity of the detection mark.

6. A heat transfer film according to claim 5, wherein the heat transfer film is of the wax type.

7. A heat transfer film according to claim 5, wherein the heat transfer film is of the sublimation transfer type.

8. A heat transfer film according to claim 5, wherein the heat transfer layer comprises respective regions of the hues of yellow, magenta and cyan and, optionally, black.

* * * * *